US006644574B1

(12) United States Patent
Lauber

(10) Patent No.: US 6,644,574 B1
(45) Date of Patent: Nov. 11, 2003

(54) MACHINE FOR CHOPPING ORGANIC CUT PRODUCTS

(75) Inventor: Peter Lauber, Breidenbach-Oberdietan (DE)

(73) Assignee: Convenience Food Systems Wallau GmbH & Co. KG, Wallau (DE)

( * ) Notice: Subject to any disclaimer, the term of this patent is extended or adjusted under 35 U.S.C. 154(b) by 1 day.

(21) Appl. No.: 10/019,461

(22) PCT Filed: Jun. 23, 2000

(86) PCT No.: PCT/EP00/05872

§ 371 (c)(1),
(2), (4) Date: Dec. 26, 2001

(87) PCT Pub. No.: WO01/00325

PCT Pub. Date: Jan. 4, 2001

(65) Prior Publication Data

(65)

(30) Foreign Application Priority Data

Jun. 25, 1999 (DE) ..... 299 11 090 U

(51) Int. Cl.[7] ..... B02C 18/30
(52) U.S. Cl. ..... 241/82.5
(58) Field of Search ..... 241/82.1–82.7

(56) References Cited

U.S. PATENT DOCUMENTS

| | | | | |
|---|---|---|---|---|
| 2,636,530 A | | 4/1953 | Williams | |
| 3,586,083 A | | 6/1971 | Neuner | |
| 4,108,387 A | | 8/1978 | Weiler | |
| 4,422,372 A | * | 12/1983 | Hoezee | 99/353 |
| 5,820,041 A | | 10/1998 | Eberhard et al. | |
| 6,029,917 A | | 2/2000 | Jensen | |

FOREIGN PATENT DOCUMENTS

| | | |
|---|---|---|
| DE | 118745 | 3/1901 |
| DE | 1167 214 | 11/1960 |
| DE | 39 15 409 C2 | 11/1990 |
| DE | 44 37 144 A1 | 10/1994 |
| EP | 0 884 106 A1 | 12/1998 |
| WO | WO 97/05953 | 2/1997 |
| WO | WO 98/28076 | 7/1998 |
| WO | WO 98/28079 | 7/1998 |

* cited by examiner

*Primary Examiner*—Mark Rosenbaum
(74) *Attorney, Agent, or Firm*—Oppedahl & Larson LLP

(57) ABSTRACT

The invention relates to a machine for chopping organic cut products, especially a meat grinder, comprising an inlet and an outlet for the cut products, at least one perforated disc (1) having a corresponding cutting head (2) and a drive shaft driving the cutting head (2), the cutting head (2) having at least one blade holder (3) with at least one blade (4) that cooperates with the perforated disc (1).

18 Claims, 4 Drawing Sheets

MACHINE FOR CHOPPING ORGANIC CUT PRODUCTS

Figure 1:
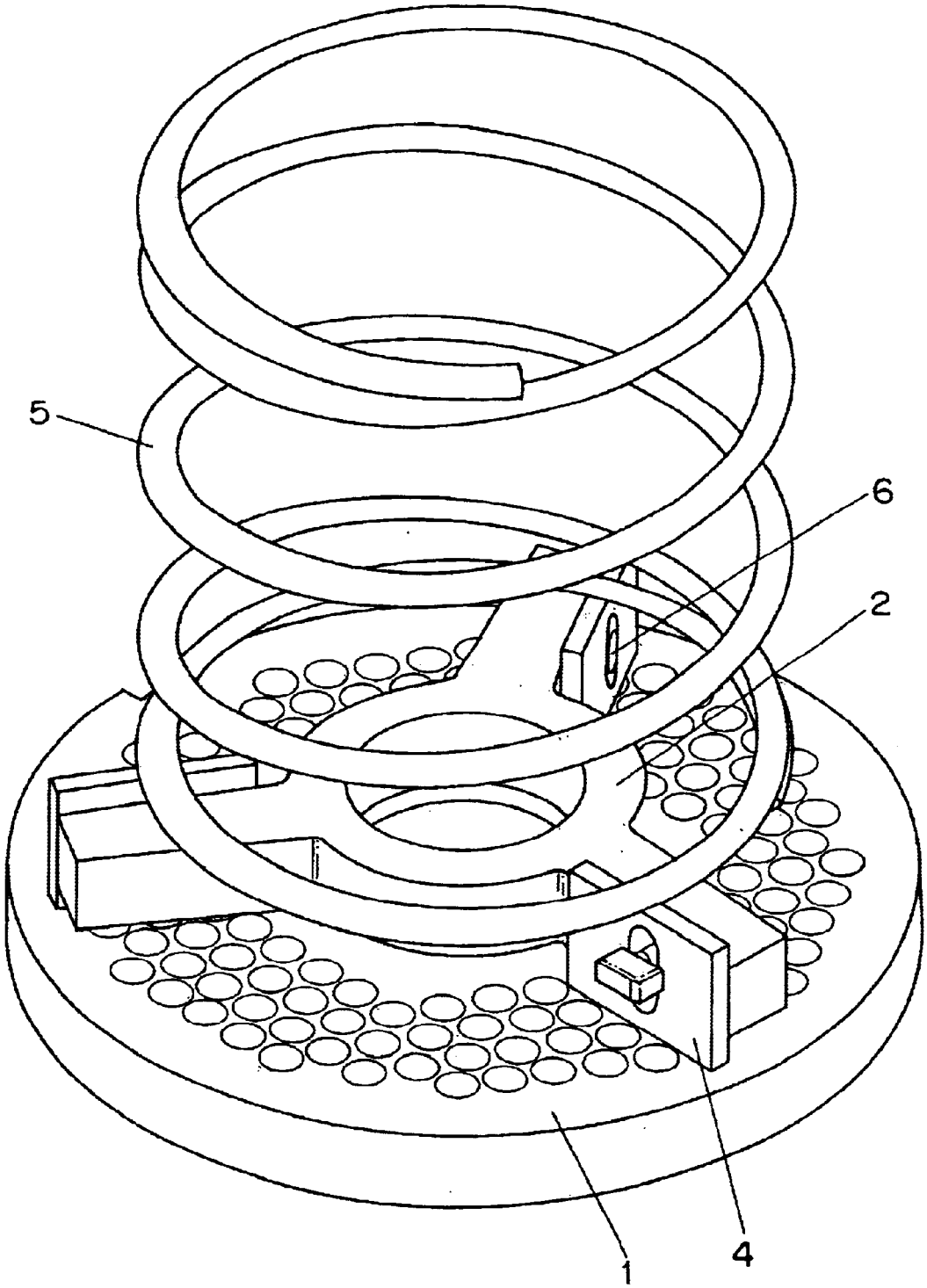

This application is a 371 application of PCT/EP00/05872, filed Jun. 23, 2000.

The invention relates to a machine for chopping organic cut products, especially a meat grinder, comprising an inlet and an outlet for the cut products, at least one perforated disc having a corresponding cutting head and a drive shaft driving the cutting head, the cutting head having at least one blade holder with at least one blade that cooperates with the perforated disc.

Machines for chopping organic cut products, especially meat grinders, are known from prior art, e.g. from WO 98/28076 wherein a grinder having an adjustable cutting means is described. In this generic printed document, the cutting head is mounted on the drive shaft so as to be axially displaceable, yet non-rotatable.

As a result of such mounting, the blade holder can be pressed by a spring against the cooperating perforated disc and re-adjusted as the cutting members undergo wear. In this way, wear of the blade or perforated disc is compensated automatically. Blade/perforated disc systems of this type function according to the principle of shearing, i.e., the cutting edges of the blades and of the perforated discs must be in permanent contact in order to be capable of chopping the cut products (in particular, tough components such as tendons in meat) with the desired high quality.

In the processing of many products, even not more than a brief interruption of contact between the cutting edges will give rise to jamming of the perforated disc, so that the machine has to be cleaned and thus, the production interrupted.

Primarily, permanent contact of the cutting edges is opposed by process-immanent wear, necessitating the spacing between the cutting edges to be corrected again and again. Furthermore, in case the cutting members are to comply with the function of conveying in addition to that of cutting, restoring forces preventing permanent contact may occur. Depending on the product, such forces may vary widely and have to be eliminated reliably.

In order to ensure contact nonetheless, various constructions have been developed in the past. Therein, either the blade or the perforated disc is displaced axially with respect to the drive shaft, thereby re-adjusting the respective counterpart. For example, such re-adjusting is effected by manual intervention by the operator, by means of prestressed spring (s) WO 98/28076, by means of hydraulic, pneumatic, motor-driven (DE 39 15 409 A1) adjusting systems, or even by utilizing the pressure exerted by the product (DE 44 37 144 A1).

While elastic (e.g. spring-loaded) solutions offer the advantage of automatic re-adjustment, they suffer from the drawback of being sensitive to restoring forces. In contrast, mechanical adjustment systems are insensitive to restoring forces, but disadvantageous in the above-mentioned cutting edge re-adjustment.

One concern in the past has been to develop and elastic system wherein the restoring forces resulting from the conveying effect would not adversely affect the shearing effect, but rather, the blades would make optimum contact with the perforated discs at all times, regardless of any operating condition. The WO 98/28076 has solved this problem by assigning the processes of conveying and cutting to different components and having the restoring forces act on the conveying elements supported on the drive shaft instead of having them act on the spring-loaded blade holders.

However, another problem of such blade/perforated disc systems is that the outer portions of the blades during their rotational movement travel a longer distance than the inner ones and therefore, the inner and outer portions of the blades undergo wear to a different extent, such wear being stronger in the outer portions, in particular. To avoid gaps thus forming between the outer portions of the blades and the perforated disc, the inner portions of the blades would have to undergo an additional and in itself unnecessary wear so as to have contact between all the portions of the blades and the perforated disc.

The invention therefore is based on the object of ensuring optimum contact between the blades and the perforated disc, particularly contact of the blades across the entire range of the cutting edge so as to achieve high quality of the final product.

Said object is accomplished in that the blade is displaceable at an angle relative to the perforated disc plane and is mounted rotatably on the blade holder, that one cutting edge of the blade is parallel to the perforated disc, and that the blade is pressed against the perforated disc by means of an elastic member.

To avoid additional and in itself unnecessary wear of the lower portion of the blades, it is a feature of the invention to hold the blades in the blade holder in such a way that the blades rotate about the axis of their holder and thus, despite uneven wear, are capable of continuously readapting to the perforated disc. This not only stabilizes the product quality, but also reduces wear of the cutting elements as a whole, thereby increasing the service life and the working safety of the machine per set of tools.

If the machine is a meat grinder, the worm conveyor thereof advantageously serves as blade holder at the same time.

According to the invention, the axis about which the blade can be rotated may extend through the blade itself. Conveniently, the cutting head has at least one blade holder with one blade each.

According to the invention, the blades can be pressed against the perforated disc by means of one or more elastic members per blade. However, the blades can also be pressed against the perforated disc by means of one or more common elastic members.

According to the invention, multiple cutting head/perforated disc combinations can be included in one single machine for chopping organic cut products. In this way, a finer division of the cut products can be achieved, because the cut products are coarsely reduced in size in a first stage, while the cut products are finely comminuted in each further cutting stage.

According to the invention, the blades in the cutting head are replaceable, and the drive shaft can be driven by a motor. Advantageously, the elastic members are springs.

Figure 2:
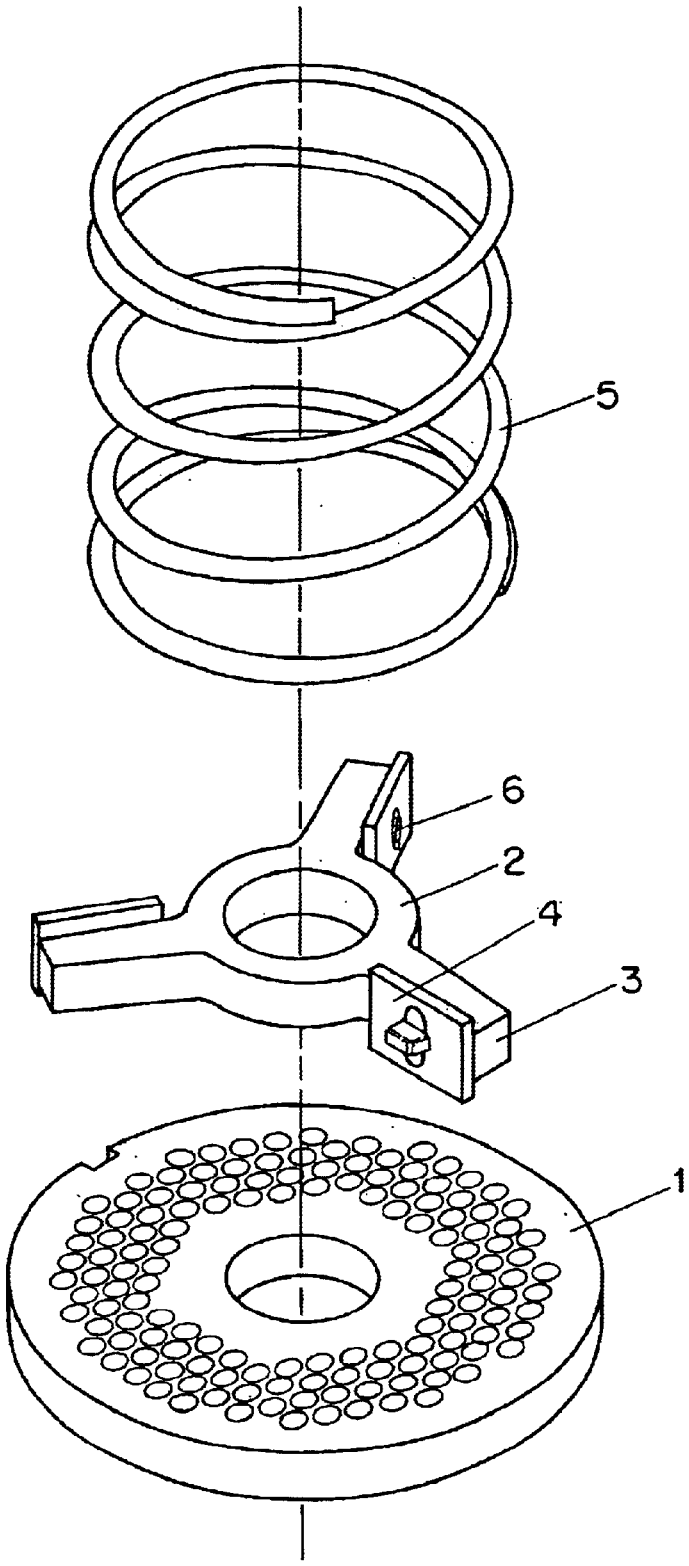
Figure 3:
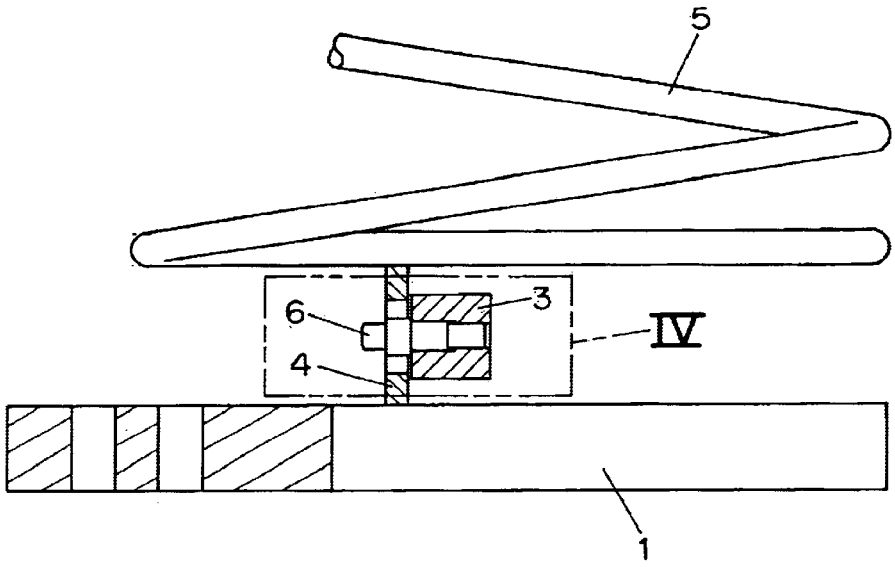
Figure 4:
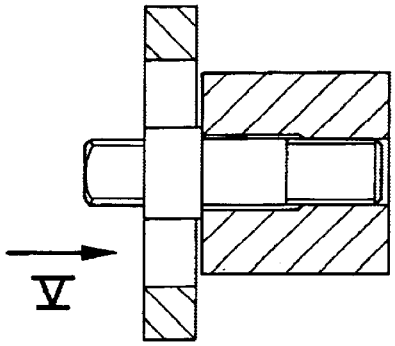
Figure 5:
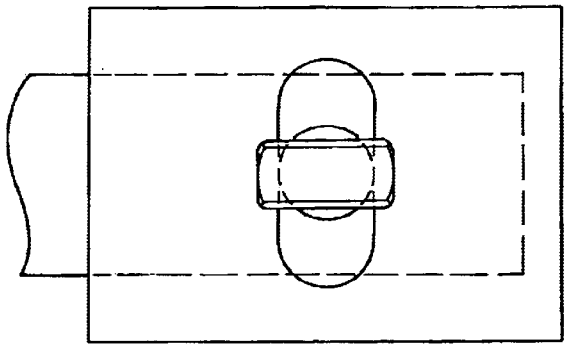
Figure 6:
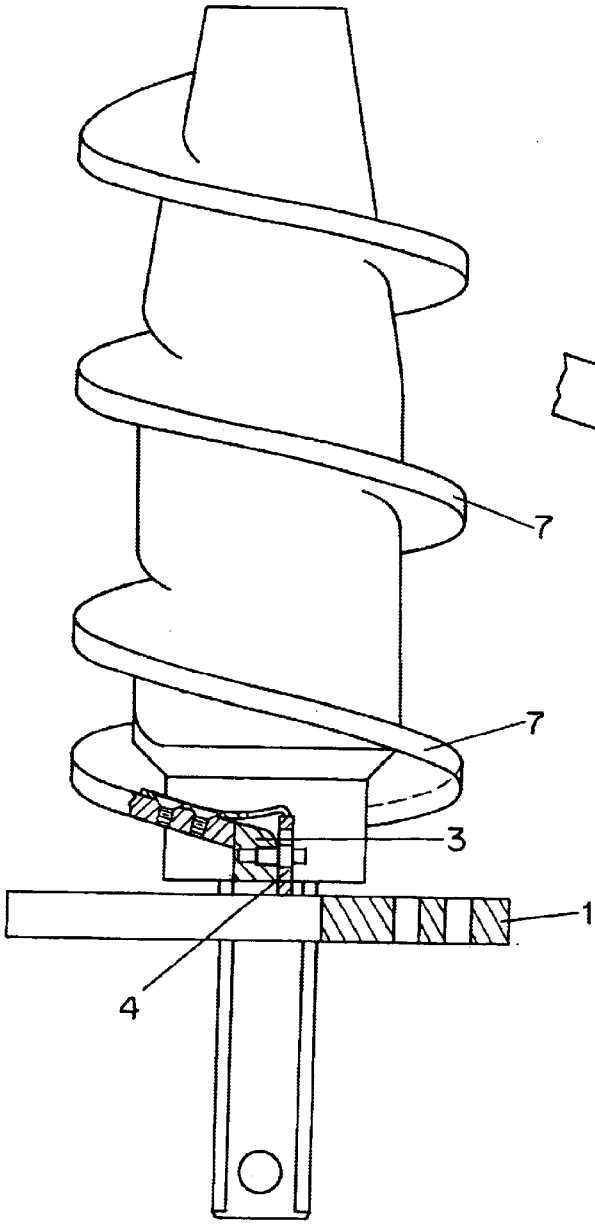
Figure 7:
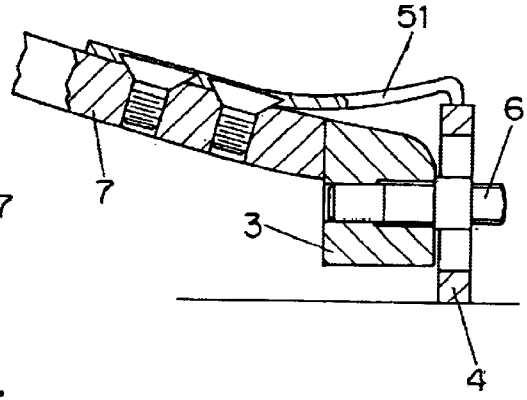

With reference to the drawings, an embodiment of the invention will be illustrated in more detail below, wherein:

FIG. 1 shows a cutting head/perforated disc combination,

FIG. 2 shows a drawing of the cutting head/perforated disc combination of FIG. 1, FIG. 3 shows a partially sectional view of the blade fixing in a cutting head/perforated disc combination according to FIG. 1, FIG. 4 illustrates an enlarged detail from FIG. 3, FIG. 5 shows an enlarged side view according to FIG. 4, FIG. 6 shows a partially sectional view of a worm conveyor simultaneously serving as blade holder, and FIG. 7 illustrates an enlarged detail of the blade fixing in accordance with FIG. 6.

The cutting head 2 of FIG. 1 has 3 blade holders 3, each having one blade 4. The blades are fixed on the blade holder by means of a fixing screw 6. The fixing screw 6 is a shank screw which, on the one hand, has a rectangular head and, on the other hand, has a shank between head and thread which is larger in diameter than the thread. Thus, a step is formed on the shank screw 6 between shank and thread. The blade 4 has an elongated hole. The size of the elongated hole is the same as or somewhat larger than that of the cuboid head of the shank screw 6.

In order to fix the blade, the shank screw 6 is screwed into the blade holder 3 until the stepped shank of the shank screw reaches the blade holder 3. The thread length of shank screw 6 is selected such that the long side of the cuboid head of shank screw 6 now is parallel or substantially parallel to the perforated disc 1. The blade 4 now is suspended on shank screw 6 on blade holder 3. To this end, the blade initially is rotated such that the cutting edge of the blade is perpendicular to the perforated disc 1. In this way, the opening of blade 4 can be pushed over the head of shank screw 6. Subsequently, the blade 4 is rotated by 90° so that the cutting edge of blade 4 makes contact with the perforated disc 1. The blade 4 in contact with perforated disc 1 is secured against rotation by larger angles and therefore is fixed undetachably on the blade holder.

The blade 4 thus mounted on blade holder 3 is pressed against the perforated disc 4 by a helical spring 5. The way of mounting and the spring 5 ensure permanent optimum contact between blade 4 and perforated disc 1. As a result, the shearing effect between blade 4 and perforated disc 1 is always present. Consequently, jamming of the perforated disc 1 is prevented. The last turn of helical spring 5 forms a plane that is largely parallel to perforated disc 1. However, this plane or the entire spring may undergo deformation to exert an individual pressure on each of blades 4 in the direction of perforated disc 1.

The only difference between the embodiment shown in FIGS. 6 and 7 and the embodiment of FIGS. 1 through 5 is that the blade holder is mounted directly on the worm conveyor of a meat grinder. Furthermore, a plate spring 51 pressing the blade 4 against perforated disc 1 is screwed on at the end of the turn. The suspension of blade 4 itself is accomplished in the same way as has been done in the embodiment of FIGS. 1 through 5. In particular, the embodiment according to FIGS. 6 and 7 is advantageous in those cases where a compact construction of the meat grinder allowing no space for a generously designed cutting head between worm conveyor and perforated disc is required.

List of reference numerals:

1 Perforated disc
2 Cutting head, comprised of items 3 and 4
3 Blade holder
4 Blade
5 Helical spring
51 Helical spring
6 Shank screw
7 Worm conveyor

What is claimed is:

1. A machine for chopping organic cut products, comprising an inlet and an outlet for the cut products, at least one perforated disc (1) having a corresponding cutting head (2) and a drive shaft driving the cutting head (2), the cutting head (2) having at least one blade holder (3) with at least one blade (4) that cooperates with the perforated disc (1), characterized in that the at least one blade (4) is displaceable at an angle relative to the perforated disc plane and is mounted rotatably on the blade holder (3), that one cutting edge of the at least one blade (4) is parallel to the perforated disc, and that the at least one blade (4) is pressed against the perforated disc (1) by means of an elastic member (5).

2. The machine for chopping organic cut products according to claim 1, characterized in that the machine is a meat grinder comprising a worm conveyor which serves as a blade holder at the same time.

3. The machine for chopping organic cut products according to claim 2, characterized in that the cutting head (2) has at least one blade holder (3) with one blade (4) each.

4. The machine for chopping organic cut products according to claim 3, characterized in that the number of blades is at least two, and each of the blades (4) is pressed against the perforated disk (1) by means of one or more elastic members (5) per blade.

5. The machine for chopping organic cut products according to claim 3, characterized in that the number of blades is at least two, and one or more common elastic members (5) press all the blades (4) against the perforated disk (1).

6. The machine for chopping organic cut products according to claim 2, characterized in that the at least one blade is replaceable.

7. The machine for chopping organic cut products according to claim 2, characterized in that the drive shaft is driven by a motor.

8. The machine according to claim 2, characterized in that the elastic member is a spring.

9. The machine for chopping organic cut products according to claim 1, characterized in that the axis about which the at least one blade (4) can be rotated extends through the blade.

10. The machine for chopping organic cut products according to claim 9, characterized in that the cutting head (2) has at least one blade holder (3) with one blade (4) each.

11. The machine for chopping organic cut products according to claim 10, characterized in that the number of blades is at least two, and each of the blades (4) is pressed against the perforated disk (1) by means of one or more elastic members (5) per blade.

12. The machine for chopping organic cut products according to claim 10, characterized in that the blades (4) are pressed against the perforated disc (1) by means of one or more common elastic members (5).

13. The machine for chopping organic cut products according to claim 1 characterized in that the cutting head (2) has at least one blade holder (3) with one blade (4) each.

14. The machine for chopping organic cut products according to claim 13, characterized in that the number of blades is at least two, and each of the blades (4)] is pressed against the perforated disk (1) by means of one or more elastic members (5) per blade.

15. The machine for chopping organic cut products according to claim 13, characterized in that the number of blades is at least two, and one or more common elastic members (5) press all the blades (4) against the perforated disk (1).

16. The machine for chopping organic cut products according to claim 1, characterized in that the at least one blade (4) is replaceable.

17. The machine for chopping organic cut products according to claim 1, characterized in that the drive shaft is driven by a motor.

18. The machine according to claim 1, characterized in that the elastic member is a spring.

* * * * *